US008800424B2

(12) United States Patent
Gangl et al.

(10) Patent No.: US 8,800,424 B2
(45) Date of Patent: Aug. 12, 2014

(54) CAPTURED SPRING ASSEMBLY FOR A FIREARM

(75) Inventors: John P. Gangl, White Bear Lake, MN (US); Dave A. Adolfson, St. Paul, MN (US)

(73) Assignee: J & K IP Assets, LLC, Cheyenne, WY (US)

( * ) Notice: Subject to any disclaimer, the term of this patent is extended or adjusted under 35 U.S.C. 154(b) by 0 days.

(21) Appl. No.: 13/487,167

(22) Filed: Jun. 2, 2012

(65) Prior Publication Data

US 2013/0319217 A1 Dec. 5, 2013

(51) Int. Cl.
*F41A 3/78* (2006.01)

(52) U.S. Cl.
USPC ..... 89/198

(58) Field of Classification Search
USPC ..... 89/198, 199; 42/1.06, 74, 97; 267/70, 267/71, 291
See application file for complete search history.

(56) References Cited

U.S. PATENT DOCUMENTS

| | | | | | |
|---|---|---|---|---|---|
| 2,361,180 | A * | 10/1944 | Dobremysl | 89/1.1 |
| 3,298,282 | A * | 1/1967 | Loffler et al. | 89/198 |
| 3,366,011 | A * | 1/1968 | Sturtevant | 89/198 |
| 3,381,405 | A * | 5/1968 | Edwards | 42/74 |
| 3,731,590 | A * | 5/1973 | Zimmerman, Jr. | 89/163 |
| 4,126,080 | A * | 11/1978 | Reynolds | 89/199 |
| 4,344,352 | A * | 8/1982 | Yates et al. | 89/198 |
| 4,522,107 | A * | 6/1985 | Woodcock et al. | 89/196 |
| 5,827,992 | A * | 10/1998 | Harris et al. | 89/191.01 |
| 5,909,002 | A * | 6/1999 | Atchisson | 89/130 |
| 7,493,845 | B2 * | 2/2009 | Mantas | 89/42.01 |
| 8,430,015 | B2 * | 4/2013 | Faifer | 89/44.01 |
| 2006/0236853 | A1 * | 10/2006 | Boersching et al. | 89/198 |

* cited by examiner

*Primary Examiner* — Gabriel Klein
(74) *Attorney, Agent, or Firm* — Bennet K. Langlotz; Langlotz Patent & Trademark Works, Inc.

(57) ABSTRACT

A captured spring assembly for a firearm has a rod having a forward and rearward ends, a movable buffer that defines an aperture that receives the forward end of the rod and is operable to reciprocate between a forward battery position and a rearward retracted position, a coil spring that encompasses the rod, wherein the forward end of the rod has a limit element having a head that is larger in diameter than the rod, wherein the buffer has an internal limit element that is larger in diameter than the rod, and wherein the internal limit element has at least one portion that is smaller in diameter than the limit element head, but also larger in diameter than the rod. There may be a spring stop attached to the rearward end of the rod that is large enough for the spring to bear against and the buffer to strike against.

18 Claims, 7 Drawing Sheets

CAPTURED SPRING ASSEMBLY FOR A FIREARM

FIELD OF THE INVENTION

The present invention relates to firearms, and more particularly to recoil springs for auto-loading rifles.

BACKGROUND OF THE INVENTION

The AR-15 is a lightweight, 5.56 mm, air-cooled, gas-operated, magazine-fed semi-automatic rifle, with a rotating-lock bolt. The main mechanism of operation for the rifle is known as direct gas impingement. Gas is trapped from the barrel as the bullet moves past a gas port located above the rifle's front sight base. The gas rushes into the port and down a gas tube, located above the barrel, which runs from the front sight base into the AR-15's upper receiver. Here, the gas tube protrudes into a "gas key" (bolt carrier key) which accepts the gas and funnels it into the bolt carrier.

The bolt and bolt carrier together effectively form a piston, which is caused to move as the cavity in the bolt carrier fills with high pressure gas. The bolt is locked into the barrel extension, so this expansion forces the bolt carrier backward a short distance in line with the stock of the rifle to first unlock the bolt. As the bolt carrier moves toward the butt of the gun, the bolt cam pin, riding in a slot on the bolt carrier, forces the bolt to turn and unlock from the barrel extension. Once the bolt is fully unlocked it begins its rearward movement along with the bolt carrier. The bolt's rearward motion extracts the empty cartridge case from the chamber, and as soon as the neck of the case clears the barrel extension, the bolt's spring-loaded ejector forces it out the ejection port in the side of the upper receiver. The bolt is much heavier than the projectile, and along with the recoil-spring pressure inside the stock buffer-tube performs the cartridge ejection function and chambers the following cartridge.

Behind the bolt carrier is a plastic or metal buffer which rests in line with a bolt return spring that pushes the bolt carrier back toward the chamber to return the bolt into battery. A groove machined into the upper receiver traps the cam pin and prevents it and the bolt from rotating into a closed position. The bolt's locking lugs then push a fresh round from the magazine which is guided by feed ramps into the chamber. As the bolt's locking lugs move past the barrel extension, the cam pin is allowed to twist into a pocket milled into the upper receiver. This twisting action follows the groove cut into the carrier and forces the bolt to twist and "lock" into the barrel's unique extension.

The bolt return spring is a simple coil spring that is confined by the outer walls of the extension tube. The spring rubs against the walls as it is compressed and extended. In some rifles, the result is a loud and annoying buzzing sound that can exceed a second in duration after each round is fired.

One attempt to address this problem is the replacement of the standard recoil spring buffer with a pneumatic piston system that uses compressed gas to store and return the recoil energy. However, this approach works only with rifles having buttstocks with full length extension tubes. Rifles or carbines having collapsible stocks, which have shorter extension tubes, cannot accommodate the pneumatic system. Pneumatic systems are also believed to have limited reliability and utility in extreme temperature environments.

Therefore, a need exists for a new and improved captured spring assembly for a firearm that reduces the noise of the bolt return spring of a firearm with either a full length or collapsible stock. In this regard, the various embodiments of the present invention substantially fulfill at least some of these needs. In this respect, the captured spring assembly for a firearm according to the present invention substantially departs from the conventional concepts and designs of the prior art, and in doing so provides an apparatus primarily developed for the purpose of constraining movement of the bolt return spring of a firearm by capturing the spring on an inner rod.

SUMMARY OF THE INVENTION

The present invention provides an improved captured spring assembly for a firearm, and overcomes the above-mentioned disadvantages and drawbacks of the prior art. As such, the general purpose of the present invention, which will be described subsequently in greater detail, is to provide an improved captured spring assembly for a firearm that has all the advantages of the prior art mentioned above.

To attain this, the preferred embodiment of the present invention essentially comprises a rod having forward and rearward ends, a movable buffer that defines an aperture that receives the forward end of the rod and is operable to reciprocate between a forward battery position and a rearward retracted position, a coil spring that encompasses the rod, wherein the forward end of the rod has a limit element having a head that is larger in diameter than the rod, wherein the buffer has an internal limit element that is larger in diameter than the rod, and wherein the internal limit element has at least one portion that is smaller in diameter than the limit element head, but also larger in diameter than the rod. There may be a spring stop attached to the rearward end of the rod that is large enough for the spring to bear against and the buffer to strike against. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
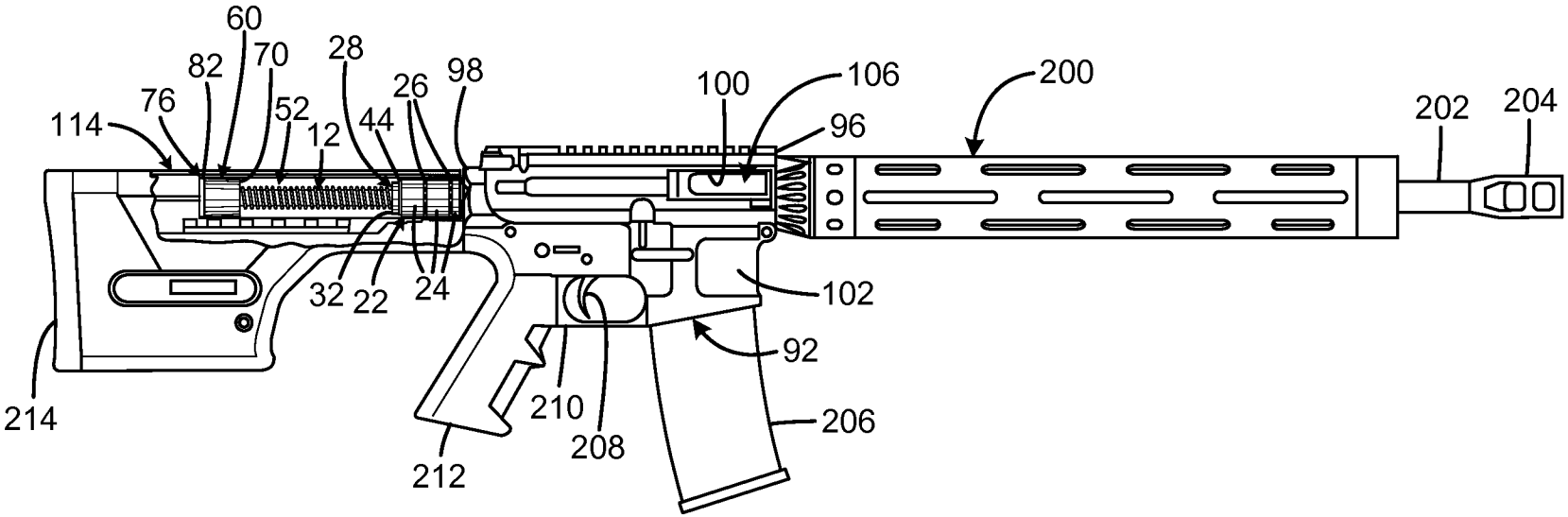
FIG. 1 is a right side view of the current embodiment of the captured spring assembly for a firearm installed in a firearm.

An embodiment of the captured spring assembly for a firearm of the present invention is shown and generally designated by the reference numeral 10.

FIG. 1 illustrates the improved captured spring assembly for a firearm 10 of the present invention. More particularly, the captured spring assembly is shown installed in a firearm 200. The firearm has a barrel 202, flash hider 204, upper receiver 92, magazine 206, trigger 208, trigger guard 210, pistol grip 212, ejection port 100, extension two 114, and buttstock 214. In the current embodiment, the firearm is an AR-15 carbine. The components of the firearm that interact with the captured spring assembly 10 will be described in more detail in the description of FIGS. 2A-3B.

Figure 1A:
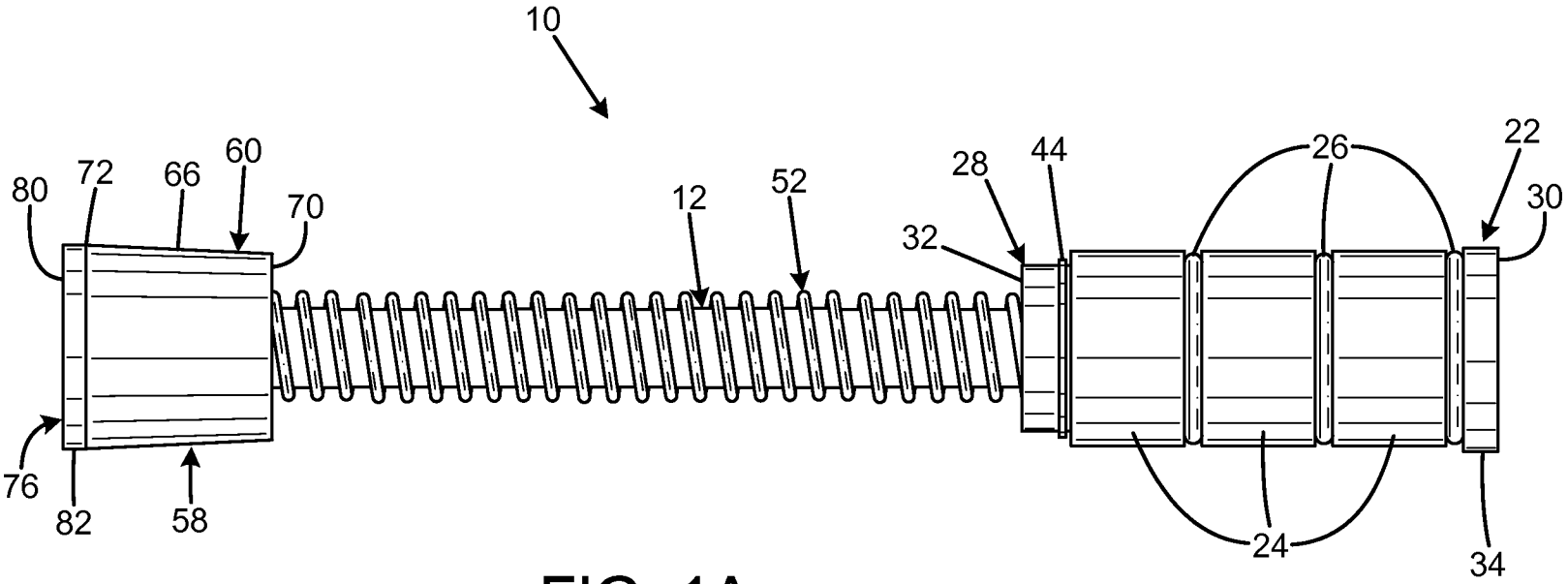
FIG. 1A is a side view of the current embodiment of the captured spring assembly for a firearm constructed in accordance with the principles of the present invention.
Figure 1B:
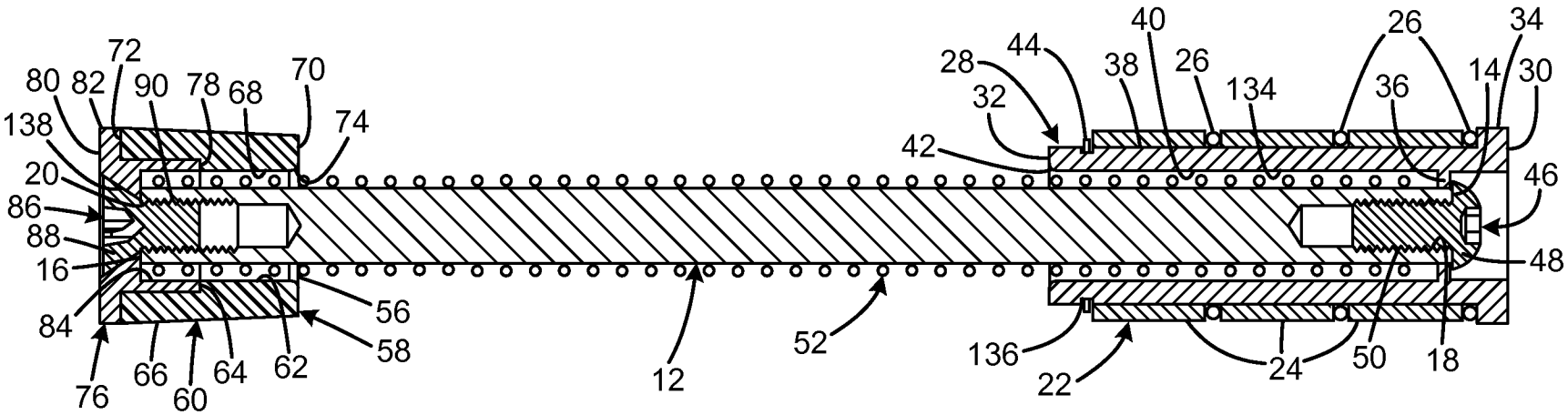
FIG. 1B is a side sectional view of the captured spring assembly of FIG. 1A.

FIGS. 1A and 1B illustrate the improved captured spring assembly for a firearm 10 of the present invention. More particularly, the captured spring assembly consists of guide rod 12 with a buffer 22 slidably mounted on the front 14 of the guide rod, a shock absorber 58 affixed to the rear 16 of the guide rod, and a bolt return spring 52 that encircles the guide rod and is captured between the buffer and the shock absorber. The front of the guide rod defines a threaded bore 18, and the rear of the guide rod defines a threaded bore 20.

The buffer 22 has a slider 28 with a central bore 134 that defines an interior surface 40. The central bore is sufficiently large to receive the front 54 of the bolt return spring 52. A flange 36 protrudes inwardly from the interior surface to define an aperture 94 and to limit forward movement of the bolt return spring. The aperture 94 is sized to closely receive the front 14 of the guide rod 12 while still permitting the slider to slide along the guide rod. The rear 32 of the interior surface defines a radiused ridge 42. The front 30 of the exterior surface 38 of the slider defines an outwardly protruding flange 34.

Three O-rings 26 and three weights 24 encircle the exterior surface 38 of the slider 28. The O-rings separate the weights from one another and from the flange 34. A slot 136 in the exterior surface near the rear 32 of the slider receives a snap ring 44 to tightly clamp the O-rings and weights between the front flange and the snap ring. The O-rings provide shock absorption for the weights and prevent the weights from rattling. The weights add mass to the buffer 22 that buffers the buffer's motion. In the current embodiment, the O-rings are made of silicone or rubber and the weights are made of steel. However, the weights can be made of alternative materials and/or made thinner or thicker to provide different masses.

Forward motion of the buffer 22 is constrained by the head 48 of a front screw 46. The threaded portion 50 of the front screw is received by the threaded bore 18 in the front 14 of the guide rod 12. The head is sized with a diameter such that the head extends outwardly beyond the guide rod and is too large to pass through the aperture 94 defined by the flange 36 in the slider 28. The front screw can be unscrewed from the threaded bore to permit removal of the slider from the guide rod for installation of the bolt return spring 52.

Rearward motion of the buffer 22 is limited by the shock absorber 58. The shock absorber 58 has a resilient portion 60 that is supported by an end cap 76. The exterior 66 of the resilient portion 60 is tapered inwardly from the rear 72 to the front 70. The resilient portion has a central bore 62 that defines an interior surface 68. The central bore is sufficiently large to permit passage of the rear 16 of the guide rod 12 and to receive the rear 56 of the bolt return spring 52. The front of the interior surface defines a radiused ridge 74. The interior surface also defines a ledge 64 at a point approximately midway between the front and the rear.

The front 78 of the end cap 76 is inserted into the rear 72 of the bore 62 of the resilient portion 60 and abuts the ledge 64. The rear 80 of the end cap is clamped to the rear 16 of the guide rod 12 by the head 88 of a rear screw 86. The threaded portion 90 of the rear screw is received by the threaded bore 20 in the rear of the guide rod. The bore 138 in the rear of the end cap and the head of the rear screw are both chamfered to produce a flush fit. The rear of the end cap defines an outwardly protruding flange 82 that abuts the rear of the resilient portion and limits the rearward movement of the resilient portion. In the current embodiment, the resilient portion is made of urethane and the end cap is made of steel.

The bolt return spring 52 encircles the guide rod 12 and is sandwiched between the rear 32 of the slider 28 of the buffer 22 and the front 70 of the resilient portion 60 of the shock absorber 58. The front 54 of the spring abuts the flange 36 of the slider, and the rear 56 of the spring abuts the rear of the central bore 84 in the end cap. The spring is a coil spring and fits tightly around the guide rod. The radiused ridge 74 facilitates insertion of the rear of the spring into the bore 62 in the front of the resilient portion and subsequently into the bore 84 in the front 70 of the end cap. The radiused ridge 42 facilitates insertion of the front of the spring into the bore 134 in the rear 32 of the slider.

Figure 2A:
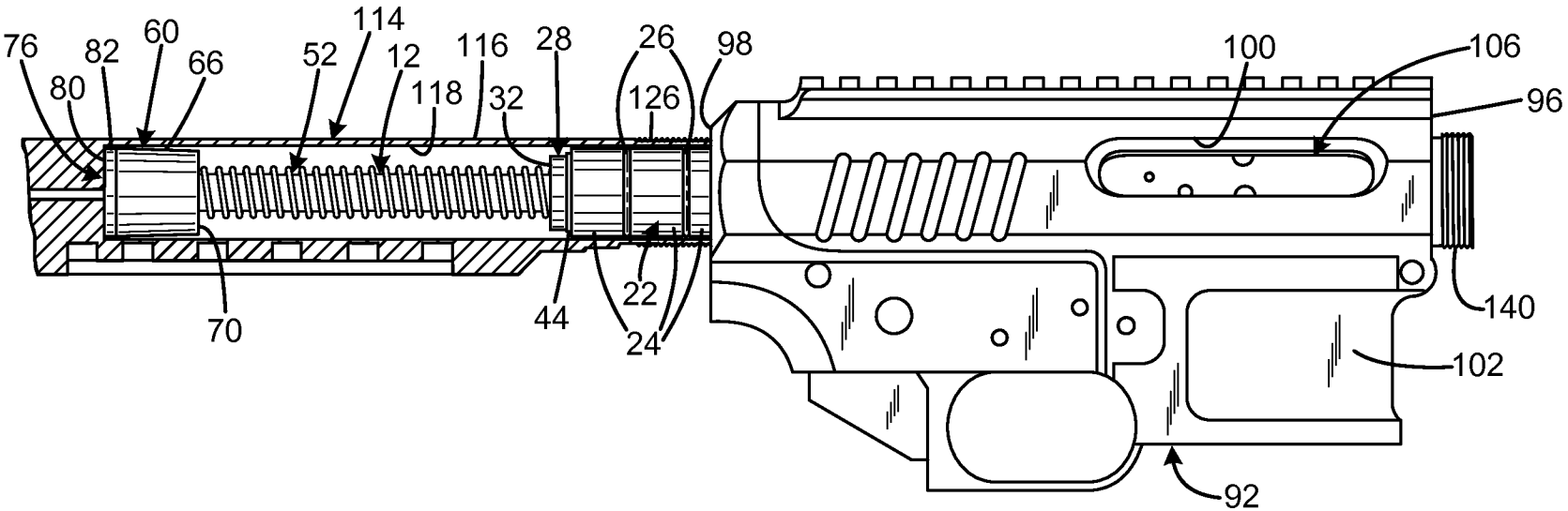
FIG. 2A is a right side sectional view of the captured spring assembly for a firearm of FIG. 1A attached to an upper receiver with the bolt carrier in the battery position.
Figure 2B:
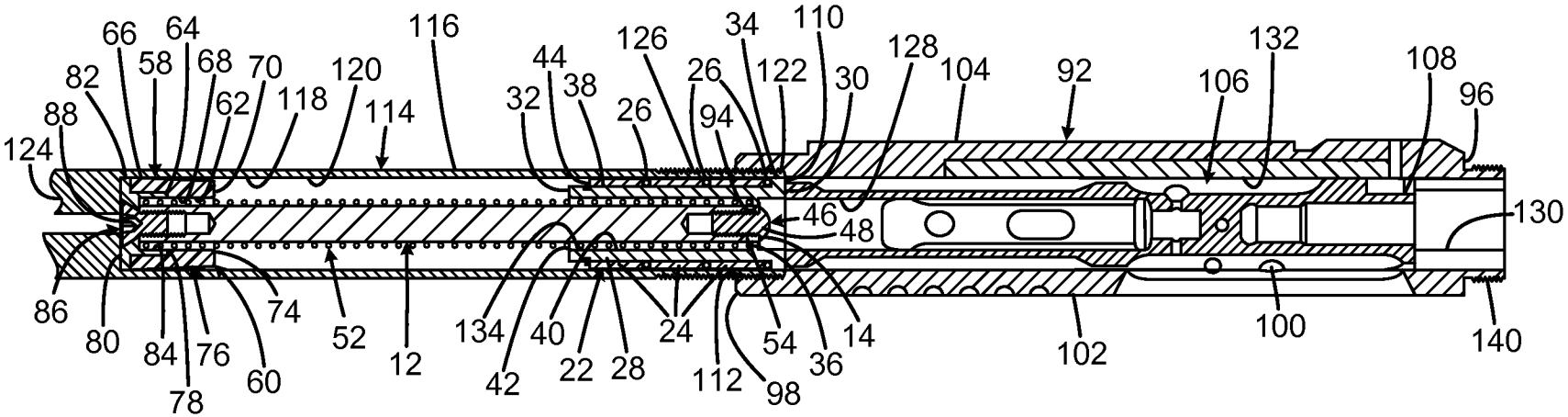
FIG. 2B is a top sectional view of the captured spring assembly for a firearm attached to an upper receiver of FIG. 2A with the bolt carrier in the battery position.

FIGS. 2A and 2B illustrate the improved captured spring assembly for a firearm 10 of the present invention. More particularly, the captured spring assembly is shown installed in the upper receiver 92 and extension tube 114 of a firearm 200 in the in battery position.

The upper receiver 92 has a left side 104, a right side 102, a front 96, and a rear 98. The right side defines an ejection port 100 that communicates with a central bore 132. The rear of the upper receiver defines a threaded bore 112 that receives threads 126 on the front 122 exterior surface 116 of the extension tube 114. A buttstock 214 is attached to the rear 124 of the extension tube. The front of the upper receiver defines threads 140 that receive the rear of a barrel.

A bolt carrier 106 is a tubular object that is slidably received by the bore 132 in the upper receiver 92. The front 108 of the bolt carrier receives a bolt 130 (shown partially in FIG. 2B and fully in FIG. 3B). The rear 110 of the bolt carrier abuts the front 30 of the slider 28 of the buffer 22 of the captured spring assembly 10.

The extension tube 114 has a central bore 120 that defines an interior surface 118. The captured spring assembly 10 is positioned within the extension tube such that the rear 80 of the end cap 76 abuts the rear of the bore 120. This constrains rearward movement of the shock absorber 58. The bore 120 closely receives the buffer 22 with a sufficient diameter to permit the buffer to slide without lateral obstruction on the guide rod 12.

In the in battery position, the bolt carrier 106 is at the forwardmost position within the upper receiver 92. The bolt return spring 52 urges the buffer 22 forward and keeps the front 30 of the slider 28 abutting the rear 110 of the bolt carrier.

Figure 3A:
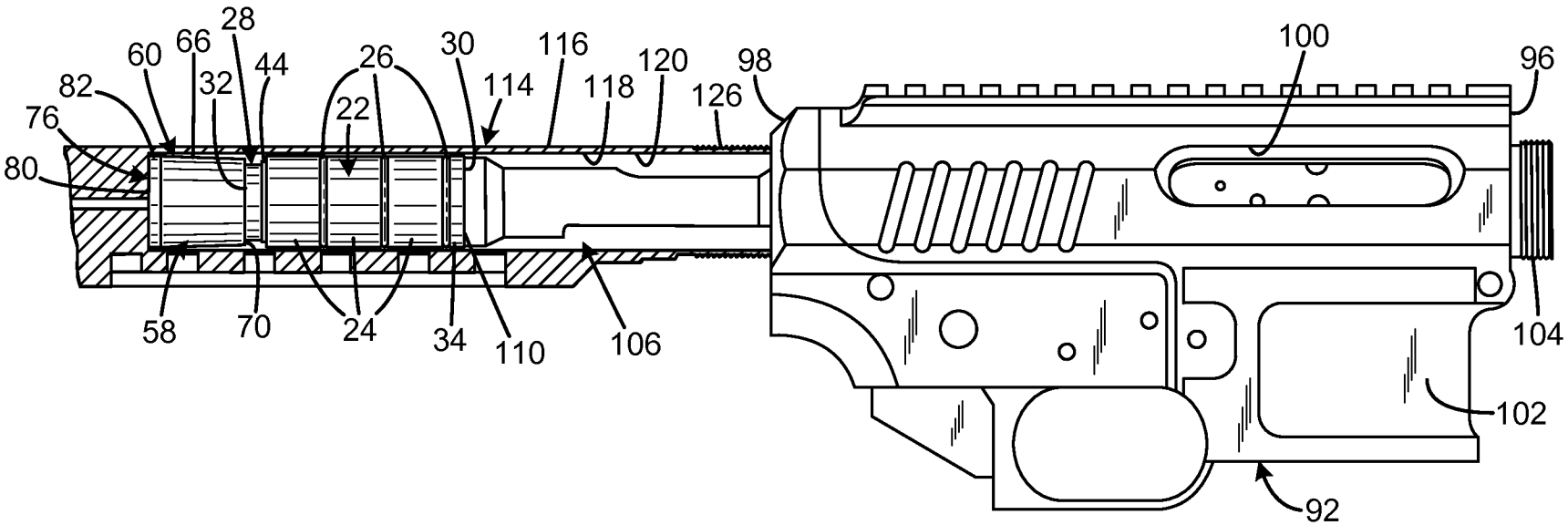
FIG. 3A is a right side sectional view of the captured spring assembly for a firearm of FIG. 1A attached to an upper receiver with the bolt carrier in the out of battery position.
Figure 3B:
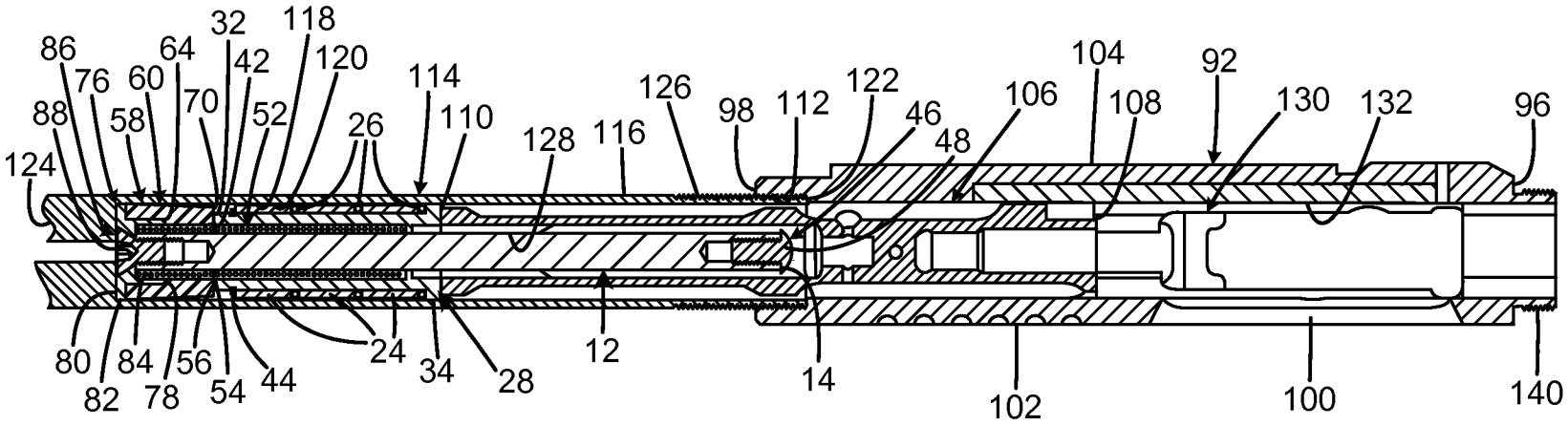
FIG. 3B is a top sectional view of the captured spring assembly for a firearm attached to an upper receiver of FIG. 3A with the bolt carrier in the out of battery position.

FIGS. 3A and 3B illustrate the improved captured spring assembly for a firearm 10 of the present invention. More particularly, the captured spring assembly is shown installed in the upper receiver 92 and extension tube 114 of a firearm in the out of battery position.

In the out of battery position, the bolt carrier 106 is at the rearwardmost position within the upper receiver 92. A bore 128 in the rear 110 of the bolt carrier receives the front 14 of the guide rod 12, which permits rearward movement of the bolt carrier within the upper receiver and into the front 122 of the bore 130 of the extension tube 120 when the trigger 208 is pulled and a round is fired. The rear of the bolt carrier pushes the buffer 22 rearward, thereby fully compressing the bolt return spring 52 between the buffer and the shock absorber 58. The inertia resulting from the mass of the buffer and the resistance of the bolt return spring act to slow the rearward movement of the bolt carrier. Once the rearward movement of the buffer 22 is stopped by contact with the shock absorber 58, the bolt return spring 52 urges the buffer 22 against the rear 110 of the bolt carrier 106 and pushes the bolt carrier forward to return the bolt carrier to the in battery position.

The resilient portion 60 of the shock absorber 58 absorbs the impact of the buffer 22 against the shock absorber, the O-rings absorb the impact of the weights against one another and the flange 34 of the slider 28, and the bolt return spring 52 is tightly held against the guide rod to limit vibration of the coil spring. All of these measures substantially reduce the amount of noise produced by the operation of the captured spring assembly 10 compared to the typical bolt return spring arrangement of a conventional AR-15.

In the context of the specification, the terms "rear" and "rearward," and "front" and "forward" have the following definitions: "rear" or "rearward" means in the direction away from the muzzle of the firearm while "front" or "forward" means it is in the direction towards the muzzle of the firearm.

While a current embodiment of a captured spring assembly for a firearm has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A buffer assembly for a firearm, the assembly comprising:

an elongated rod having a forward end and a rearward end;

a cylindrical buffer that defines a buffer bore that receives the rod and is operable to reciprocate between a forward battery position and a rearward retracted position;

a coil spring that encompasses the rod;

the buffer bore receiving a forward portion of the spring;

a resilient spring stop attached to the rearward end of the rod, the spring stop having a diameter larger than the spring diameter;

wherein the resilient spring stop defines a central spring stop bore that receives a rear portion of the spring;

wherein the forward end of the rod has a limit element having a head that is larger in diameter than the rod;

wherein the buffer has an internal limit element that is larger in diameter than the rod;

wherein the internal limit element has at least one portion that is smaller in diameter than the limit element head, but also larger in diameter than the rod;

the spring stop having a limit spring support surface and the buffer having a buffer spring support surface, each spring support surface supporting a respective end of the spring, and facing each other;

wherein when the buffer is in the rearward retracted position it contacts the spring stop such that the spring is entirely contained by the central spring stop bore and the buffer bore when the buffer is in the rearward retracted position.

2. The assembly of claim 1 wherein the rod limit element is removable for disassembly of the assembly.

3. The assembly of claim 1 wherein the buffer comprises:

a cylindrical slider that defines an aperture that receives the forward end of the rod and has an exterior surface that defines an outwardly protruding flange;

a weight encompassing a portion of the exterior surface;

a O-ring positioned between the flange and the weight; and a snap ring removably connected to the exterior surface of the slider to retain the weight on the slider.

4. The assembly of claim 3 further comprising at least one additional weight and at least one additional O-ring, wherein the weights are separated by the O-rings and the snap ring retains the weights on the slider.

5. The assembly of claim 3 wherein the internal limit element is an internally protruding flange positioned within the aperture of the slider.

6. The assembly of claim 1 wherein the spring stop comprises:

a rigid end cap that is attached to the rearward end of the rod; and a resilient bushing that is mounted on a forward portion of the end cap and defines an aperture that receives the rearward end of the rod.

7. The assembly of claim 1 wherein the buffer has an interior cylindrical gap that receives the spring.

8. The assembly of claim 7 wherein the buffer has an interior flange defining an aperture smaller than the spring diameter and an enlarged bore portion larger than the spring diameter.

9. The assembly of claim 1 wherein the spring stop has an interior cylindrical gap that receives the spring.

10. A buffer assembly for a rifle having a bolt carrier having a rear end and defining an aperture, the assembly comprising:

a rod having a forward end and a rearward end;

wherein the aperture of the bolt carrier receives the forward end of the rod when the bolt carrier is in a rearward retracted position;

a movable buffer that defines an aperture that receives the forward end of the rod and is operable to reciprocate between a forward battery position and a rearward retracted position;

the buffer having a forward end abutting the rear end of the bolt carrier;

a coil spring that encompasses the rod;

wherein the forward end of the rod has a limit element having a head that is larger in diameter than the rod;

wherein the buffer has an internal limit element that is larger in diameter than the rod; and wherein the internal limit element has at least one portion that is smaller in diameter than the limit element head, but also larger in diameter than the rod.

11. The assembly of claim 10 wherein the entire buffer is rearward of the entire bolt carrier.

12. The assembly of claim 11 further comprising a spring stop attached to the rearward end of the rod that is large enough for the spring to bear against and the buffer to strike against.

13. The assembly of claim 12 wherein the buffer has an interior cylindrical gap that receives the spring and wherein the spring stop has an interior cylindrical gap that receives the spring such that when the buffer is positioned against the spring stop when the bolt carrier is in a rearward retracted position, the spring is received within the gaps.

14. The assembly of claim 13 wherein the spring returns the buffer and the bolt carrier to the forward battery position from the rearward retracted position.

15. The assembly of claim 12 wherein the spring stop comprises:

a steel end cap that is attached to the rearward end of the rod by a screw; and a urethane bushing that fits over a forward portion of the end cap and defines an aperture that receives the rearward end of the rod.

16. A buffer assembly for a firearm, the assembly comprising:

an elongated rod having a forward end and a rearward end;

a cylindrical buffer that defines a bore that receives the rod and is operable to reciprocate between a forward battery position and a rearward retracted position;

a coil spring that encompasses the rod;

wherein the forward end of the rod has a limit element having a bead that is larger in diameter than the rod;

wherein the buffer has an internal limit element that is larger in diameter than the rod;

wherein the internal limit element has at least one portion that is smaller in diameter than the limit element head, but also larger in diameter than the rod; and wherein the buffer further comprises:

a cylindrical slider that defines an aperture that receives the forward end of the rod and has an exterior surface;

a weight encompassing a portion of the exterior surface; and a snap ring removably connected to the exterior surface of the slider to retain the weight on the slider.

17. The buffer assembly of claim 16 further comprising:

at least one additional weight and at least one O-ring, wherein the weights are separated by an O-ring and the snap ring retains the weights on the slider.

18. A buffer assembly for a firearm, the assembly comprising:

an elongated rod having a forward end and a rearward end;

a cylindrical buffer that defines a bore that receives the rod and is operable to reciprocate between a forward battery position and a rearward retracted position;

the buffer including a body portion and a weight element on the body portion with a resilient element intervening between the weight and the body portion, a coil spring that encompasses the rod;

a spring stop attached to the rearward end of the rod, the spring stop having a diameter larger than the spring diameter;

wherein the spring stop comprises:

a rigid end cap that is attached to the rearward end of the rod; and a resilient bushing that is mounted on a forward portion of the end cap and defines an aperture that receives the rearward end of the rod;

wherein the forward end of the rod has a limit element having a head that is larger in diameter than the rod;

wherein the buffer has an internal limit element that is larger in diameter than the rod; and wherein the internal limit element has at least one portion that is smaller in diameter than the limit element head, but also larger in diameter than the rod.

* * * * *